US007198541B2

(12) United States Patent
Falla

(10) Patent No.: US 7,198,541 B2
(45) Date of Patent: Apr. 3, 2007

(54) BRASSIERE STRAP CONNECTOR

(75) Inventor: Gloria Falla, Demarest, NJ (US)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 0 days.

(21) Appl. No.: 10/822,435

(22) Filed: Apr. 12, 2004

(65) Prior Publication Data

US 2005/0227585 A1 Oct. 13, 2005

(51) Int. Cl.
*A41C 3/12* (2006.01)
*A41C 3/00* (2006.01)

(52) U.S. Cl. ..... 450/86; 2/336; 24/172; 24/197; 24/200

(58) Field of Classification Search ..... 450/86, 450/85, 88, 26, 28, 58, 59, 62, 64, 73; 2/336, 2/326–331, 271; 24/172, 197, 198, 200
See application file for complete search history.

(56) References Cited

U.S. PATENT DOCUMENTS

| | | | | |
|---|---|---|---|---|
| 244,776 | A | 7/1881 | Wales | |
| 348,871 | A | 9/1886 | Wales | |
| D30,718 | S | 5/1899 | Jackson | |
| D33,816 | S | 1/1901 | Hyde | |
| D36,165 | S | 12/1902 | Houle | |
| 760,393 | A | 5/1904 | Hazard | |
| 837,103 | A | 11/1906 | Nonnemacher | |
| 873,445 | A | 12/1907 | Maltby | |
| 912,204 | A * | 2/1909 | Tacy | 24/198 |
| 1,285,027 | A | 11/1918 | Butts | |
| 1,346,702 | A * | 7/1920 | Colter | 24/305 |
| 1,361,113 | A | 12/1920 | Stevens | |
| 1,365,862 | A * | 1/1921 | Stevens | 24/315 |
| D59,620 | S | 11/1921 | Bruner | |
| 1,405,471 | A | 2/1922 | Wiener | |
| 1,926,751 | A | 9/1933 | Mix et al. | |
| 2,001,505 | A | 5/1935 | Schottenfels | |
| D100,061 | S | 6/1936 | Walsh | |
| 2,269,696 | A * | 1/1942 | Shaulson | 24/200 |
| 2,278,153 | A | 3/1942 | Shaulson | |
| D133,541 | S | 8/1942 | Kasen | |
| D135,278 | S | 3/1943 | Zavolner | |
| 2,363,017 | A | 11/1944 | Plehn | |
| D157,386 | S | 2/1950 | Lombardi | |
| D162,932 | S | 4/1951 | Burnham | |
| 2,643,431 | A | 6/1953 | Schwarz | |
| D185,345 | S | 6/1959 | Burnham | |
| D188,766 | S | 9/1960 | Read | |
| 3,075,268 | A | 1/1963 | Schwartz | |
| 3,077,650 | A | 2/1963 | Horne | |
| 3,115,878 | A | 12/1963 | Markham | |
| 3,529,329 | A | 9/1970 | Burleson | |
| 3,623,487 | A | 11/1971 | Chiu | |

(Continued)

FOREIGN PATENT DOCUMENTS

| | | |
|---|---|---|
| FR | 661885 | 7/1929 |
| FR | 1038180 | 9/1953 |

*Primary Examiner*—Gloria Hale
(74) *Attorney, Agent, or Firm*—Ohlandt, Greeley, Ruggiero & Perle, L.L.P.

(57) ABSTRACT

A brassiere shoulder strap connector is shaped so that the shoulder strap is positioned at a desired angle to better accommodate the anatomy of the wearer's shoulder. Preferably, the connector has a triangular shape.

14 Claims, 6 Drawing Sheets

U.S. PATENT DOCUMENTS

| | | | | |
|---|---|---|---|---|
| 3,698,399 | A | | 10/1972 | Hand |
| 3,699,971 | A | * | 10/1972 | Hittel et al. ..... 450/67 |
| D246,704 | S | | 12/1977 | Ophir |
| 4,309,799 | A | | 1/1982 | Noda |
| 4,330,890 | A | | 5/1982 | Weber-Unger |
| D267,909 | S | | 2/1983 | Fildan |
| 4,411,269 | A | | 10/1983 | Weintraub |
| 4,520,533 | A | | 6/1985 | Kasa |
| D322,234 | S | | 12/1991 | Fildan |
| 5,971,834 | A | | 10/1999 | Murray |
| 6,179,687 | B1 | | 1/2001 | Lee et al. |
| D445,723 | S | | 7/2001 | Kim |
| 6,684,463 | B1 | | 2/2004 | Yang |
| 6,715,186 | B1 | | 4/2004 | Huang |
| 6,780,081 | B2 | | 8/2004 | Chen et al. |
| 2004/0198176 | A1 | | 10/2004 | Dutka et al. |
| 2004/0226147 | A1 | | 11/2004 | Fildan et al. |

* cited by examiner

BRASSIERE STRAP CONNECTOR

BACKGROUND OF THE INVENTION

1. Field of the Invention

The present invention generally relates to a connector for a brassiere. More particularly, the present invention relates to a shaped connector for connecting a brassiere shoulder strap preferably to a brassiere, preferably to a back panel of the brassiere.

2. Description of Related Art

The common problem with a shoulder strap of a brassiere is that the strap can be misaligned on a wearer's shoulder and, thus, will dig into the shoulder due to the connection of the shoulder strap to the back panel of the brassiere. Even if the shoulder strap is aligned properly, it may nonetheless become uncomfortable after use due to the shape of the shoulder strap, its alignment with the back panel, and the anatomy of the shoulder and back of the wearer.

There is a need for a brassiere strap that avoids misalignment, improves the connection between the back panel and shoulder strap to provide angular flexibility to adapt or conform to the actual anatomy of a top of a wearer's shoulder, thereby enhancing comfort for the wearer. Accordingly, such a connector needs to be angled so that the shoulder strap, at its connection to the back panel, is angularly biased thereby enhancing comfort, since there is no slippage of the shoulder strap off the shoulder.

SUMMARY OF THE INVENTION

It is an object of the present invention to provide a connector for a brassiere shoulder strap that connects a shoulder strap to a brassiere, preferably at a back panel of the brassiere.

It is an additional object of the present invention to provide a connector for a brassiere shoulder strap that connects a shoulder strap to a brassiere at a front panel of the brassiere.

It is another object of the present invention to provide a connector for a brassiere shoulder strap that biases the shoulder strap as desired while on the shoulder of the wearer.

It is still another object of the present invention to provide such a connector for a brassiere shoulder strap that has a triangular shaped configuration.

It yet another object of the present invention to provide such a connector that forms a heart shape.

It is a further object of the present invention to provide such a connector for a brassiere shoulder strap that has two arms that meet at one edge and angle away from each other at the distal edges.

It is a still further object of the present invention to provide such a connector for a brassiere shoulder strap that has two arms that meet at one edge and form the same angle away from each other.

It is a yet further object of the present invention to provide such a connector for a brassiere shoulder strap that has two arms that meet at one edge and form an angle away from each other, which angle is an acute angle.

It is a still yet further object of the present invention to provide such a connector for a brassiere shoulder strap that has two arms that meet at one edge and form an angle away from each other, which angle is about forty degrees.

These and other objects and advantages of the present invention are achieved by the connector of the present invention. The connector is for use, preferably to connect a brassiere shoulder strap to the brassiere. The connector comprises a first arm having a first end and a second end, a second arm having a first end connected to the first end of the first arm and having a second end that angle away from the second end of the first arm. Preferably, the connector has a wave or top portion that connects the second end of the first arm and the second end of the second arm together. In a preferred embodiment, the first arm is positioned for sliding engagement with a shoulder strap of a brassiere, and the second arm is positioned for sliding engagement with an edge of a back panel of the brassiere so that the shoulder strap and the edge form that same angle. The connector provides that the shoulder strap and back panel angle towards the spine of a wearer.

The wave portion can form an opening for sliding engagement the shoulder strap and back panel to the connector. In preferred embodiments, the wave portion has a flange to separate or space the shoulder strap from the material that is connected to the back panel. Also, the wave portion preferably has tapered sides of the flange to engage the shoulder strap and the material.

BRIEF DESCRIPTION OF THE DRAWINGS

These and other features, aspects, and advantages of the present disclosure will become better understood with regard to the following description, appended claims and accompanying drawings:

DETAILED DESCRIPTION OF THE INVENTION

Figure 2:
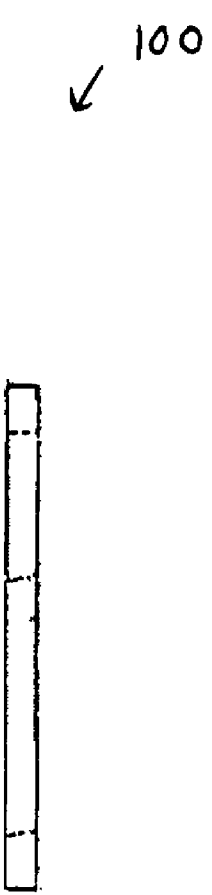
FIG. 2 is a side view of the fastener of FIG. 1.
Figure 1:
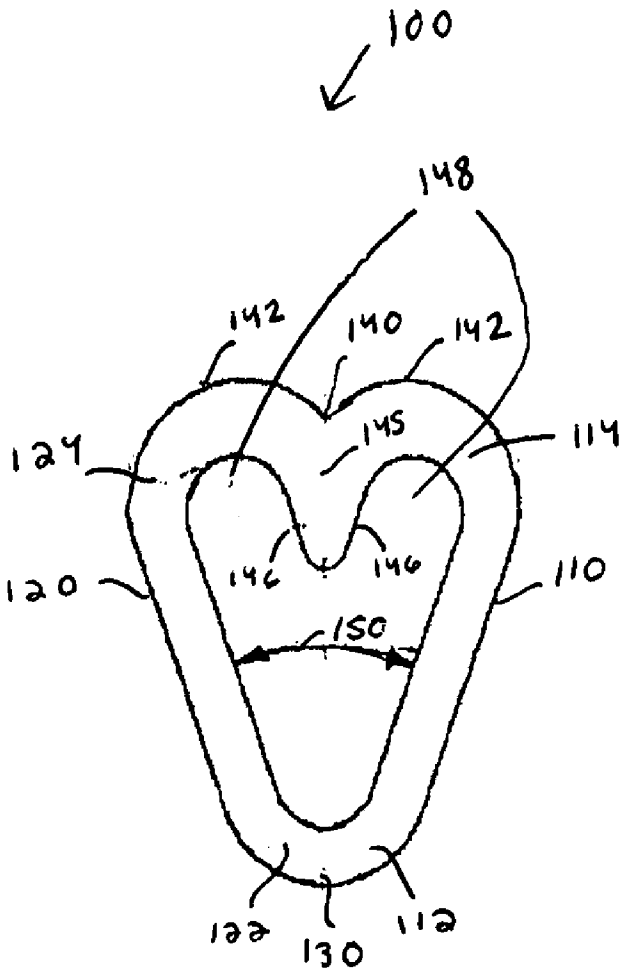
FIG. 1 is a plan view of an example fastener of the present invention.

Referring to the drawings and, in particular, FIGS. 1 and 2, there is shown a first embodiment of a fastener of the present invention generally represented by reference numeral 100. In this first embodiment, the fastener 100 has a first side or arm 110 with a first end 112 and a second end 114, and a second side or arm 120 with a first end 122 and a second end 124. The first end 112 of the first arm 110 and the first end 122 of the second arm 120 preferably meet or connect at point or plane 130. Preferably, connector 100 has a third or top or wave portion 140 that connects together the second end 114 of first arm 110 and the second end 124 of second arm 120.

The first arm 110 and second arm 120 form an angle 150 with respect to each other. The angle 150 determines the bias of the shoulder strap and the other part, such as a back panel, of a brassiere with respect to each other. The angle 150 is any acute angle, such as between about 25 to 45 degrees, and preferably about 27 to 41 degrees.

The third or wave portion 140 has a pair of symmetric arcuate portions 142 that meet at a flange 145. The flange 145 preferably aligns axially with the point 130 of connection of first end 112 of first arm 110 and the first end 122 of second arm 120. The flange 145 preferably has a pair of tapered sides 146, separating the shoulder strap and back strap or any extension of the back strap, such as, for example, the back elastic. In a front-opening brassiere, the flange 145 separates the shoulder strap and front strap. Preferably, the tapered sides 146 taper at an angle that makes the sides parallel to first and second arms 110, 120. Thus, a pair of slots 148 are formed therebetween.

The connector 100 has any angular configuration in which there are two arms or portions that provide a non-parallel relationship with respect to each other. Preferably, connector 100 has a triangular shape configuration. More preferably, connector 100 has a heart shape configuration.

As shown in FIG. 2, connector 100 has a thin profile so as not to appear bulky or feel heavy when on the shoulder of a wearer. In the back closure brassiere shown in FIGS. 3 to 6, connector 100 separates the shoulder strap and back strap.

Figure 3:
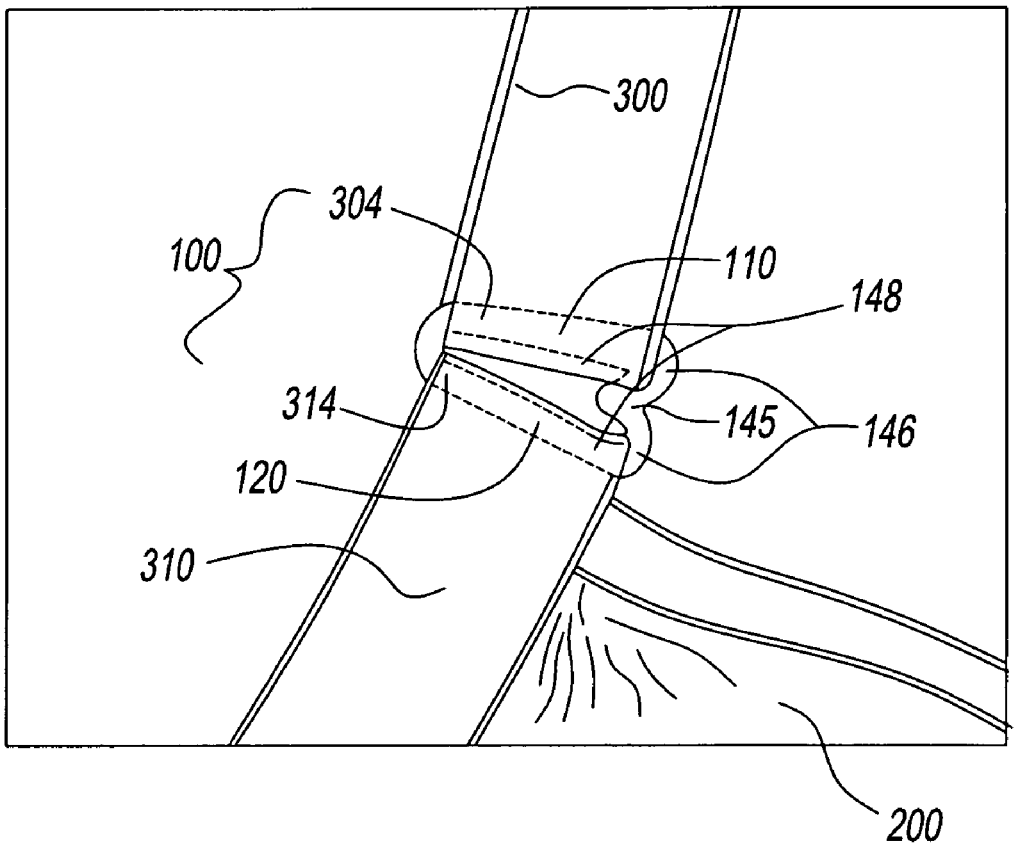
FIG. 3 is a plan view of the fastener of FIG. 1 engaging a shoulder strap and back panel of a brassiere.
Figure 4:
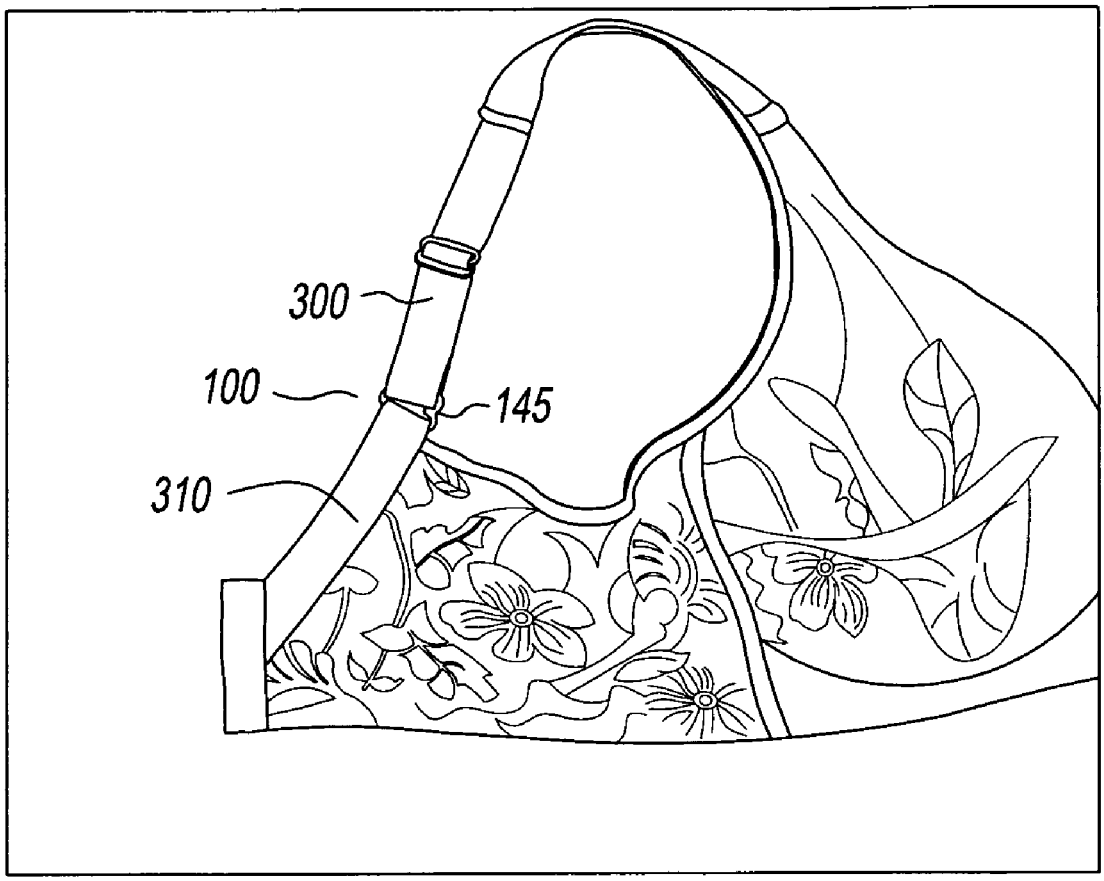
FIG. 4 is a second plan view of the brassiere of FIG. 3.

Referring to FIGS. 3 and 4, connector 100 is shown in position on a brassiere 200. First arm 110 engages a shoulder strap 300 by being positioned in a hollow end 304 of the shoulder strap. Likewise, second arm 120 engages a hollow edge or material 314 of a back panel 310. In this embodiment, shoulder strap 300 and back panel 310 are angled inward towards each other and towards the spine of the wearer, or generally towards the center or spine of a wearer's back, forming a v-shape.

The angle of the shoulder strap 300 and material 314 of back panel 310 comes from the angle 150 of fastener 100. The angle 150 can be varied to achieve various effects. In the embodiment shown, both first arm 110 and second arm 120 are angled away from plane 130. However, in an alternative, less preferred embodiment, first arm 110 or second arm 120 may be parallel to plane 130, while the other of the first and second arms is angled away from each other.

The flange 145, due to its width between its pair of sides 146, separates shoulder strap 300 and material 314. The sides 146 of flange 145 and first arm 110 and second arm 120 preferably form parallel edges to form a pair of slots 148 for receipt of hollow end 304 of shoulder strap 300 and material 314 of back panel 310.

As stated before, connector 100 may also be used on any extensions of the back strap. Connector 100 may also be used with a front strap for a front-opening brassiere. Connector 100 is made of any material conventionally used for brassiere connectors, such as metal or plastic. Preferably, connector 100 is made of high carbon steel coated with nylon powder. Thus, a preferred connector 100 has a weight of about 85% steel and 15% nylon.

Figure 5:
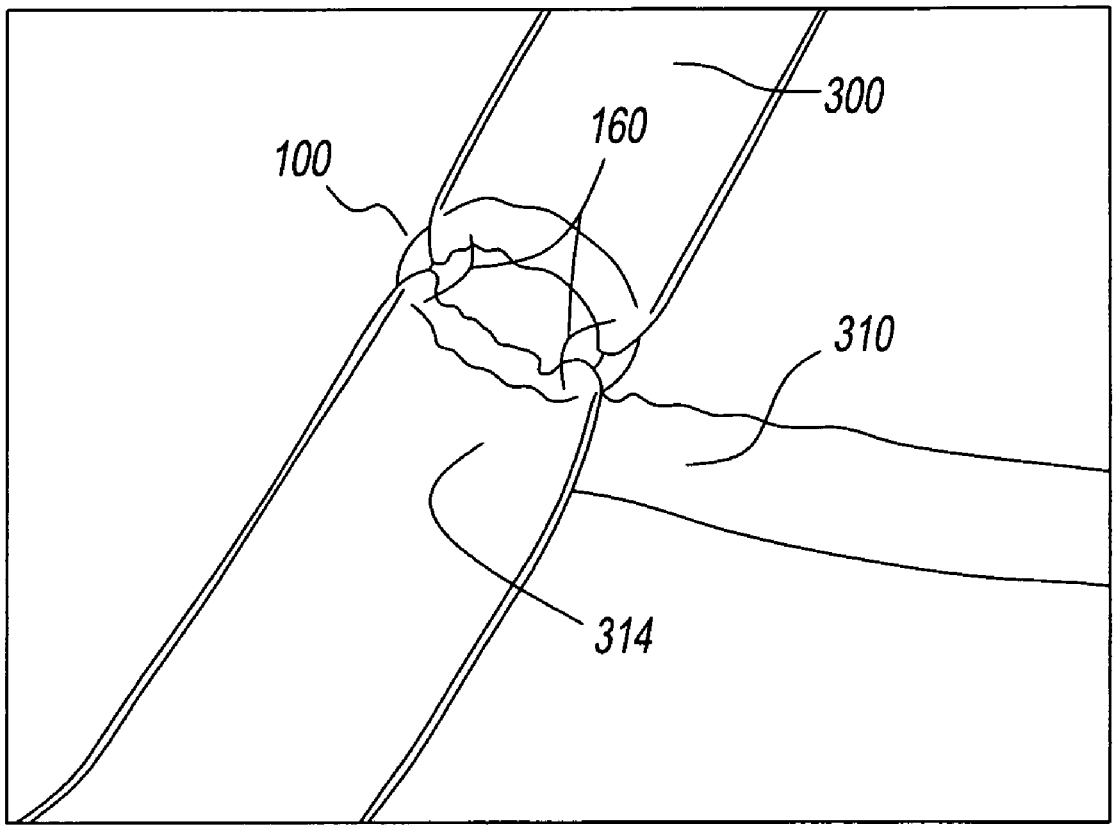
FIG. 5 is a plan view of a second embodiment of the fastener of the present invention engaging a shoulder strap and a back panel of a brassiere.
Figure 6:
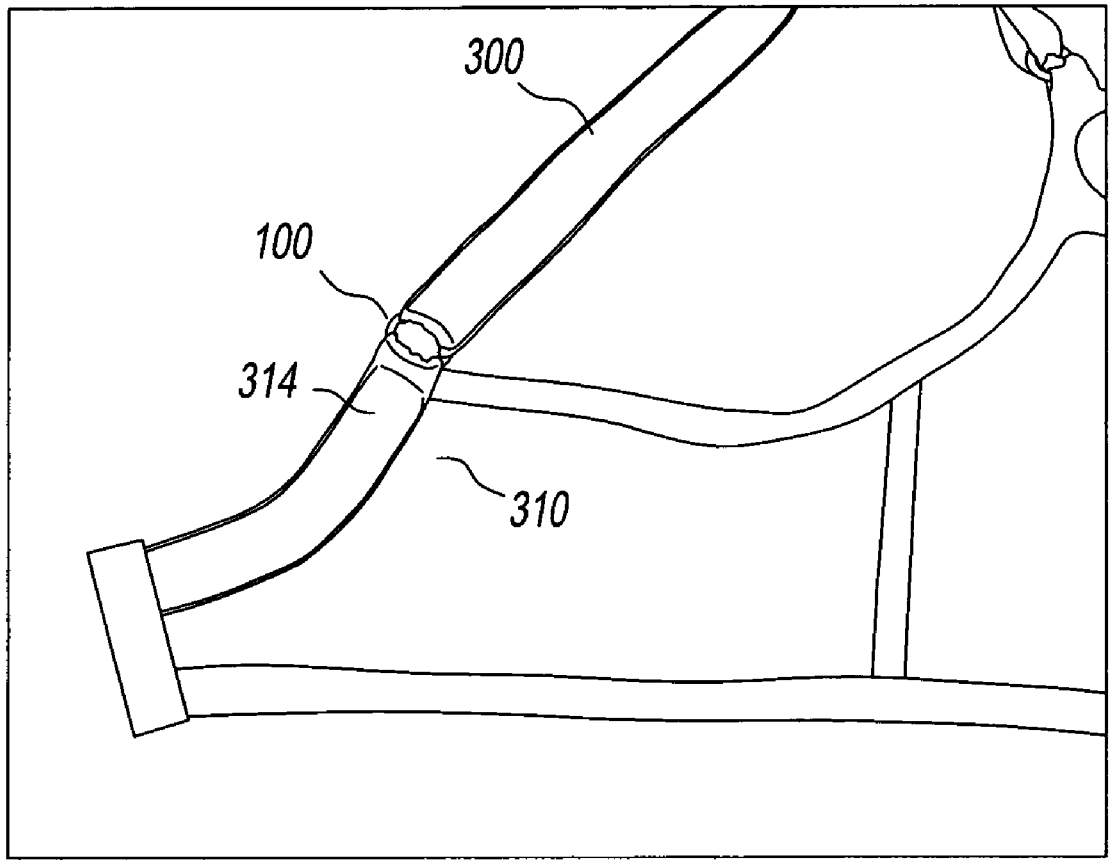
FIG. 6 is a second plan view of the brassiere of FIG. 5.

FIGS. 5 and 6 show a second embodiment of the fastener 100 of the present invention. In this embodiment, fastener 100 has an oval configuration or shape. Also, fastener 100 has a pair of angles 160. As a result, shoulder strap 300 and material 314 of back panel 310 again are angled or biased with respect to each other.

Figure 7:
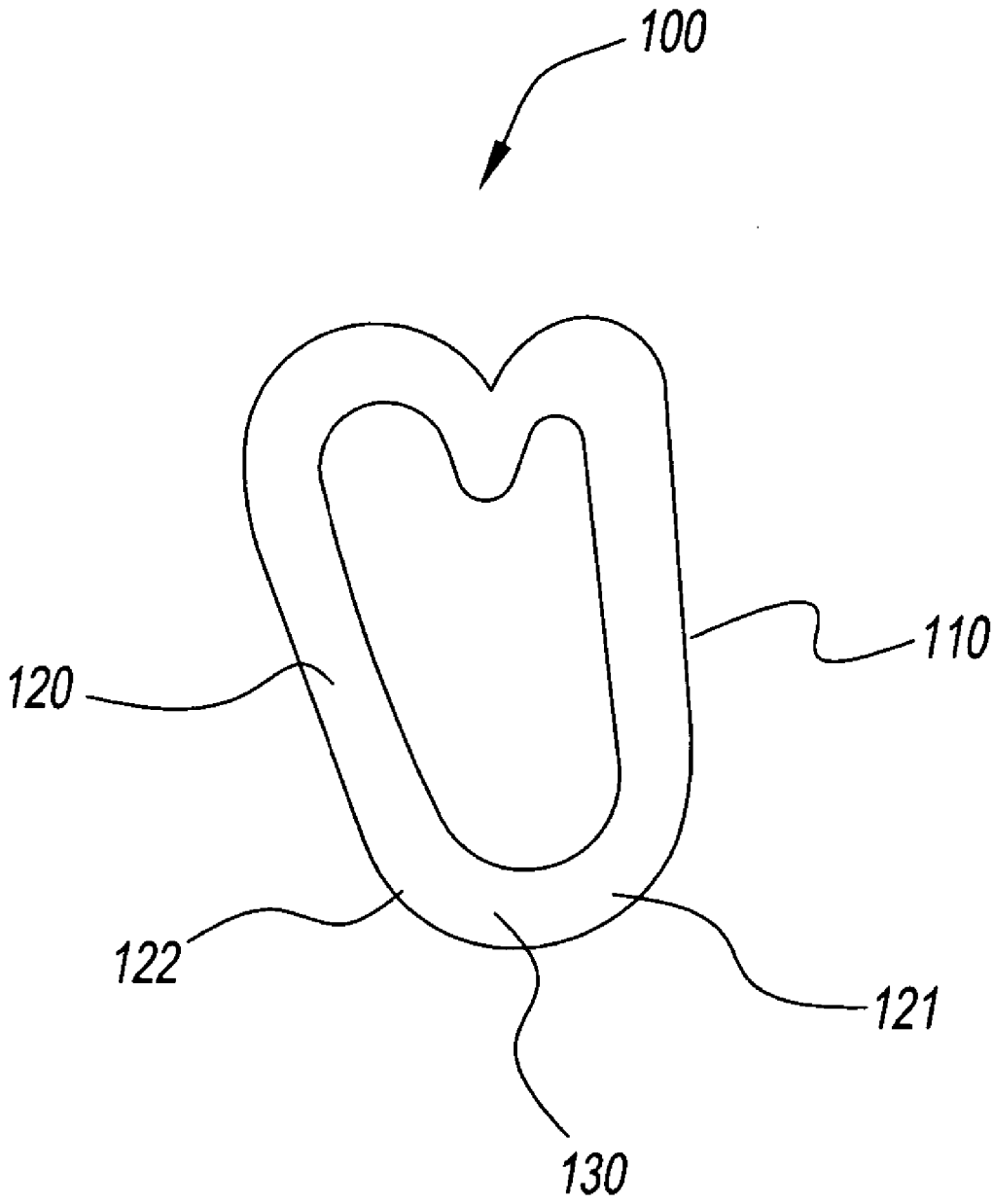
FIG. 7 is a plan view of a third embodiment of the fastener of the present inveion engaging a shoulder strap and a back panel of a brassiere.

FIG. 7 shows a third embodiment of the fastener 100 of the present invention. In this embodiment, fastener 100 has a configuration similar to the embodiment of FIG. 1; however, one of first arm 110 or second arm 120 is at an angle with respect to plane 130 while the other of first arm 110 or second arm 120 is parallel to plane 130. In FIG. 7, while second arm 120 is shown at an angle relative to plane 130, first arm 110 could have been at an angle relative to plane 130 and second arm 120 could have been parallel to plane 130.

It is to be understood that the drawings and detailed description are intended to be illustrative and not restrictive. Embodiments other than the examples in the drawings and detailed description may be used. Other embodiments will be apparent to those of skill in the art upon reviewing the above description, such as square, octagon, triangle, and other shapes and various angles for the fastener. Structural, mechanical, and material changes may be made without departing from the spirit and scope of the present disclosure. Various designs of brassieres and other intimate apparel are contemplated by the present disclosure, even though some minor elements would need to change, such as design and function. The present invention has applicability to fields other than brassieres, such as athletic apparel. Therefore, the scope of the present invention should be determined with reference to the appended claims, along with the full scope of equivalents to which such claims are entitled.

What is claimed is:

1. A fastener for connecting a back panel and a shoulder strap of a brassiere, comprising:

a first arm for engagement with the shoulder strap;

a second arm connected to said first arm and at an angle with respect to said first arm, for engagement with a portion of the back panel; and a wave portion, wherein said wave portion has a flange having a pair of tapered sides; wherein said pair of tapered sides are parallel to said first arm and said second arm, wherein said fastener creates an angle between said shoulder strap and said back panel and biases said portion of said back panel downward toward a spine of a wearer.

2. The fastener of claim 1, wherein said first arm, said second arm, and said wave portion form a triangular shape.

3. The fastener of claim 1, wherein said first arm, said second arm, and said wave portion form a heart shape.

4. The fastener of claim 1, wherein said first arm and said second arm are connected together at one end to form a plane.

5. The fastener of claim 1, wherein said first arm has a first end and a second end, and wherein said second arm has a first end and a second end.

6. The fastener of claim 5, wherein said first end of said first arm and said first end of said second arm meet to form a plane.

7. The fastener of claim 1, wherein said shoulder strap and said back panel are biased toward each other.

8. The fastener of claim 1, wherein said shoulder strap and said back panel are biased away from each other.

9. A fastener for connecting a back panel and a shoulder strap of a brassiere, comprising:

a first arm for engagement with the shoulder strap; and a second arm connected to said first arm and at an angle with respect to said first arm, for engagement with a portion of the back panel, wherein said fastener creates an angle between said shoulder strap and said back panel and biases said portion of said back panel downward toward a spine of a wearer, wherein said angle is about 24 to about 45 degrees.

10. The fastener of claim 9, wherein said angle is about 27 to about 41 degrees.

11. A fastener for connecting a back panel and a shoulder strap of a brassiere, comprising:

a first arm for engagement with the shoulder strap, said first arm having a first end and a second end;

a second arm for engagement with the back panel, said second arm having a first end and a second end, said first end of said second arm being connected to said first end of said first arm to form a plane, said second end of said second arm forming an angle with respect to said second end of said first arm; and a wave portion connecting said second end of said first arm and said second end of said second arm, wherein said wave portion has a flange; wherein said flange has a pair of tapered sides, said tapered sides being parallel to said first arm and said second arm, wherein said fastener biases a portion of said back panel towards said shoulder strap.

12. The fastener of claim 11, wherein one of said first and second arms is angled with respect to the plane, while the other of the first and second arms is parallel to said plane.

13. A fastener for connecting a back panel and a shoulder strap of a brassiere, comprising:

a first arm for engagement with the shoulder strap, said first arm having a first end and a second end;

a second arm for engagement with the back panel, said second arm having a first end and a second end, said first end of said second arm being connected to said first end of said first arm to form a plane, said second end of said second arm forming an angle with respect to said second end of said first arm; and a wave portion connecting said second end of said first arm and said second end of said second arm being disposed between said first arm and said second arm, wherein said fastener biases a portion of said back panel towards said shoulder strap, wherein said angle is about 24 to about 45 degrees.

14. A fastener for connecting a back panel and a shoulder strap of a brassiere, comprising:

a first arm for engagement with the shoulder strap;

a second arm connected to said first arm and at an angle with respect to said first arm, for engagement with a portion of the back panel;

a flange disposed between said first arm and said second arm; and a pair of arcuate portions, one of said arcuate portions connected to said first arm and said flange and the other of said arcuate portions connected to said second arm and said flange, wherein said flange is coplanar with said first arm and said second arm and said first arm and one of said pair of arcuate portions and said second arm and the other of said pair of arcuate portions are symmetric about a centerline bisecting said angle and said flange.

* * * * *